US009779581B2

(12) United States Patent
Fujii et al.

(10) Patent No.: US 9,779,581 B2
(45) Date of Patent: Oct. 3, 2017

(54) AMUSEMENT SYSTEM

(71) Applicant: KONAMI DIGITAL ENTERTAINMENT CO., LTD., Tokyo (JP)

(72) Inventors: Tomoaki Fujii, Minato-ku (JP); Naoya Osawa, Minatu-ku (JP); Hiroyuki Muraki, Minato-ku (JP); Yoshiko Hojo, Minato-ku (JP); Keiichi Nakajima, Minato-ku (JP); Kazuya Takahashi, Minato-ku (JP); Taku Tateyama, Minato-ku (JP)

(73) Assignee: KONAMI DIGITAL ENTERTAINMENT CO., LTD., Minato-Ku, Tokyo (JP)

( * ) Notice: Subject to any disclaimer, the term of this patent is extended or adjusted under 35 U.S.C. 154(b) by 378 days.

(21) Appl. No.: 14/388,755

(22) PCT Filed: Mar. 29, 2013

(86) PCT No.: PCT/JP2013/059592
§ 371 (c)(1),
(2) Date: Sep. 26, 2014

(87) PCT Pub. No.: WO2013/147185
PCT Pub. Date: Oct. 3, 2013

(65) Prior Publication Data

US 2015/0087423 A1 Mar. 26, 2015

(30) Foreign Application Priority Data

Mar. 30, 2012 (JP) ..... 2012-081060

(51) Int. Cl.
*G07F 17/32* (2006.01)

(52) U.S. Cl.
CPC ..... *G07F 17/3225* (2013.01); *G07F 17/3218* (2013.01); *G07F 17/3244* (2013.01); *G07F 17/3255* (2013.01)

(58) Field of Classification Search
CPC .... A63F 9/24; G07F 17/3225; G07F 17/3218; G07F 17/3244; G07F 17/3255
See application file for complete search history.

(56) References Cited

U.S. PATENT DOCUMENTS 6,609,970 B1 * 8/2003 Luciano, Jr. ..... G06Q 30/02 463/16
2010/0075735 A1 * 3/2010 Luciano, Jr. ..... G07F 17/42 463/17
2011/0294558 A1 12/2011 Kim

FOREIGN PATENT DOCUMENTS

CN 102356410 A 2/2012
JP 2000-176163 A 6/2000
(Continued)

OTHER PUBLICATIONS

International Search Report (PCT/JP2013/059592); Date of Mailing: May 14, 2013.
Baseball Heroes 2011 Shine Star, Gekkan Arcadia, Enterbrain, Inc., Sep. 30, 2011, vol. 12, No. 11, pp. 106 to 107.
Professional Baseball Dream Nine, Dengeki Game Appli, Ascii Media Works Inc., Dec. 14, 2011, vol. 1, pp. 14 to 19.
(Continued)

*Primary Examiner* — Kang Hu
*Assistant Examiner* — Jeffrey Wong
(74) *Attorney, Agent, or Firm* — Howard & Howard Attorneys PLLC

(57) ABSTRACT

There is provided an amusement system which expands an opportunity that a user obtains a prize relating to a game. In an amusement system where: the game can be played on a user terminal using a game server portion of a server apparatus; a prize relating to the game is selected by the game server portion in association with an operation by a user to the user terminal; and the user can use the selected prize in the game, a vendor apparatus being constructed as
(Continued)

a physical apparatus different from the user terminal is connected to the server apparatus, a prize is selected by the game server portion based on an operation by a user to the vendor operation, and printing-output is performed by a printer of the vendor apparatus as one example of a physical prize corresponding to the selected prize.

13 Claims, 7 Drawing Sheets

(56) References Cited

FOREIGN PATENT DOCUMENTS

| | | | | |
|---|---|---|---|---|
| JP | 2000176163 | A | * | 6/2000 |
| JP | 2002-042233 | A | | 2/2002 |
| JP | 2002-306837 | A | | 10/2002 |
| JP | 2002306837 | A | * | 10/2002 |
| JP | 2003-016333 | A | | 1/2003 |
| JP | 2006-181196 | A | | 7/2006 |
| JP | 2006181196 | A | * | 7/2006 |
| JP | 2007-206823 | A | | 8/2007 |
| JP | 2011-182863 | A | | 9/2011 |

OTHER PUBLICATIONS

Oshare Majo Love and Berry DS Collection, Kanzen Hozonban DS Soft All Catalog 07Summer, Nintendo Dream, the August issue Bessatsu Furoku, Mainichi Communications Inc., Aug. 1, 2007, vol. 12, No. 8, p. 55.

* cited by examiner

D3

| | 1 | 1+ | 2 | 2s | 2+ | 2+s | 3 | | X | Xs |
|---|---|---|---|---|---|---|---|---|---|---|
| Web Free | 75 | 10 | 5 | — | 1. 5 | — | 1 | | 0. 005 | — |
| Wev Paid | — | 15 | 55 | — | 8 | — | 4 | | 1 | — |
| Vendor | — | 5 | 15 | 40 | 5 | 10 | 5 | | 2 | 1 |

AMUSEMENT SYSTEM

TECHNICAL FIELD

The present invention relates to an amusement system having a lottery function for a prize.

BACKGROUND ART

Provided and actually used are various online amusement systems where a server apparatus and a terminal apparatus where a game is played are connected with each other via a network and various services relating to the game are provided from the server apparatus to the terminal apparatus. For example, offered is a system where a game is played by using technique of the SNS (the abbreviation of "Social Net working System. And so forth.) on a browser of the terminal apparatus of a user (for example, see the patent literature 1.). Further, also offered is an online selling system where a purchase terminal installed in a store, or a user terminal apparatus such as a portable phone or a personal computer, and a server apparatus are connected with each other via a network, and the server apparatus selects any one of prizes from a predetermined group of prizes based on an instruction of a user, and provides the won prize to the user (for example, see the patent literature 2.).

CITATION LIST

Patent Literature

PTL1: JP-A-2007-206823 and PTL2: JP-A-2002-42233.

SUMMARY OF INVENTION

Technical Problem

In the online amusement system like the above one in the patent literature 1, it is general to allow a user to obtain sequentially in association with predetermined conditions, various kinds of contents (or, the rights for use of the contents) such as items and characters to be used in a game. In this case, for adding eventuality and unpredictability, sometimes applied is a method that a lottery is performed for contents positioned as prizes and a user can obtain a won prize. However, in a case that the prizes are only selected in association with operations on the game terminal apparatus in the online amusement system, the user is allowed to get an opportunity to obtain the prize only in a closed virtual world of the online game.

Then, the aim of the present invention is to provide an amusement system where opportunities that a user obtains prizes associated with a game are expanded.

Solution to Problem

An amusement system as one aspect of the present invention includes a sever apparatus to which a game terminal apparatus for playing a predetermined game connects via a network, the server apparatus being provided with: a storage device configured to store prize data corresponding to each of a plurality of prizes related to the game; a computer unit; and a lottery device configured by the computer unit to execute processing for selecting a prize to be given to a user from a group of prizes as game-terminal lottery candidates, to which at least one part of the plurality of prizes are set, the prize being selected in association with an operation by the user to the game terminal apparatus, and for making the prize data corresponding to the prize selected available for the user in the game, wherein the amusement system further includes a vendor apparatus configured as a physical apparatus different from the game terminal apparatus and connected to the server apparatus via the network, the vender apparatus is provided with: a computer unit; a lottery request device which is configured by the computer unit to request a lottery for a prize to the server apparatus based on an operation by a user; and a prize output device which is configured by the computer unit to obtain the prize data or data equivalent to the prize data from the server apparatus as prize output data, and output the prize to the user in a predetermined state (as one example of the state, a physical card CDp) based on the prize output data, the lottery device of the server apparatus is configured by the computer unit to, in response to a request for the lottery from the lottery request device of the vendor apparatus, select the prize to be given to the user from a group of prizes as vendor lottery candidates, to which at least one part of the plurality of prizes are set, and notify information for identifying the prize selected (as one example of the information, a card number) to the vendor apparatus, and the prize output device of the vendor apparatus is configured by the computer unit to identify the prize selected based on the information notified from the lottery device, and output the prize for the user based on the prize output data corresponding to the prize identified.

According to the amusement system of the present invention, the following processing is executed: the lottery device selects a prize in association with the operation by a user to the game terminal apparatus, and the user is allowed to use the prize data corresponding to the prize selected. In addition, the lottery device performs a lottery based on the operation by a user to the vendor apparatus, and the prize data or the data equivalent to the prize data is provided from the server apparatus to the vendor apparatus as the prize output data, and the prize is output in a predetermined state for the user based on the prize output data. Accordingly, the user can, not only get an opportunity of obtaining of the prize in a closed virtual world, but also obtain the prize by using the vendor apparatus. In other words, not limited to a user operating the game terminal apparatus, it is possible to also provide to a user operating the vendor apparatus, the opportunity of obtaining the prize relating to a game. Therefore, it is possible to expand the opportunities a user obtains the prize. As the number of installed vendor apparatuses and the number of places where the vendor apparatus is installed increase, the effect thereof becomes more remarkable. By using the existence of the vendor apparatus itself or the prize put out from the vendor apparatus as a medium, it is possible to get publicity for the existence of the game, enhance the visibility of the game in an actual world, give a motivation to play the game to a lot of users, and promote the expansion of the number of users of the game and the user segments of the game.

According to the present invention, at least one part of the plurality of prizes corresponding to the prize data stored in the storage device of the server apparatus are set to the group of prizes as the game-terminal lottery candidates, and also at least one part of the plurality of prizes corresponding to the prize data stored in the storage device of the server apparatus are set to the group of prizes as the vendor lottery candidates. That is, the maximum range of the groups of prizes as the lottery candidates is shared. Accordingly, when new prize data is added to the storage device of the server apparatus accompanying update of the game or the like, it is possible to add the new prize data of this case not only to the game-terminal lottery candidates, but also to the vendor lottery candidates. It is not necessary to prepare each prize data independently for each lottery candidate, and it is possible to reduce troublesome work for storing data, and reduce an amount of data storage on the storage device 21.

In one embodiment of the present invention, the prize output device may be configured by the computer unit to output a physical prize based on the prize output data. Thereby, it is possible to provide to a user on the vendor apparatus, a prize as a physical matter existing in an actual world by replacing the prize displayed as a virtual matter on the game terminal apparatus with the physical matter. Therefore, it is possible to raise a user appetite for collection with respect to the prizes, or raise a feeling of pleasure of users with respect to owning the prizes.

Further, the prize output device may be configured by the computer unit to output the physical prize by printing on a predetermined printing medium, an image at least one part of which is shared with the prize to be displayed on the game terminal apparatus based on the prize data. In place of, or in addition to this, the prize output device may be configured by the computer unit to output a model corresponding to the identified prize as the physical prize based on the prize output data.

The prize output device may be configured to perform printing output of an identification information portion on the printing medium together with the image of the prize, the identification information portion representing the information for identifying the prize selected in a readable manner for the game terminal apparatus, and the server apparatus may be further provided with an information processing device configured by the computer unit to execute processing for: obtaining from the game terminal apparatus, the information for identifying the prize read out from the identification information portion by the game terminal apparatus; identifying the prize outputted by the prize output device based on the information obtained; and allowing the user to use in the game the prize data corresponding to the prize identified. Thereby, by making the game terminal apparatus read out information of the identification information portion of the prize which has been provided from the vendor apparatus to the user, in the server apparatus, executed is the processing for identifying the prize corresponding to the information, and allowing the user to use the prize data corresponding to the prize. Accordingly, it is possible to use a virtual prize on the game terminal apparatus, by replacing the prize provided to the user as a physical matter with the virtual prize. Thereby, it is possible to raise interest of a user who has obtained the card on the vendor apparatus, and it is possible to give the user a strong motivation to the game-play.

In one embodiment of the present invention, the vendor apparatus may be further provided with a storage device storing the prize output data obtained from the server apparatus, the prize output device may be configured by the computer unit to: determine whether or not the prize output data corresponding to the identified prize exists in the storage device of the vendor apparatus; output the prize for the user based on the prize output data in the storage device when the prize output data exists; and obtain the prize output data from the server apparatus to make the storage device of the vendor apparatus store the prize output data when the prize output data does not exist. Thereby, once when the vendor apparatus obtains the prize output data from the server apparatus, the prize output data is stored in the storage device of the vendor apparatus. After that, in a case that it is necessary to output the prize by using the same prize output data, it is possible to use the data in the storage device of the vendor apparatus again, without obtaining newly the prize output data from the server apparatus. Thereby, it is possible to suppress time loss due to data obtainment, and to promote the reduction of the loads of the server apparatus, while promoting the speed-up of prize output.

The group of prizes as the vendor lottery candidates may include a prize which is not included in the group of prizes as the game-terminal lottery candidates (as one example, the prizes of the ranks "2s", "2+s", "Xs" in FIG. 6). Thereby, as the prize which is obtainable only by the lottery for the vendor apparatus can be made to occur, it is possible to lead a user to the lottery for the vender apparatus in order to obtain such kind of card.

The plurality of prizes may be sectioned into a plurality of ranks, the storage device of the server apparatus may store a lottery table where a probability that each rank is selected in the lottery is allocated for each rank of the prize, and the lottery device may be configured by the computer unit to select one of the ranks according to the probability described in the lottery table, and select according to a predetermined rule, the prize to be given to the user from the prizes belonging to the rank selected. Thereby, in the lottery for the game terminal apparatus or the lottery for the vendor apparatus, whichever, the lottery device accesses the same lottery table to obtain the probability allocation, selects the rank according to the probability, and selects the prize to be given to the user from the prizes belonging to the rank selected. Accordingly, it is possible to commonalize lottery procedures, and reduce the man-hour of programming work with respect to the lottery. By communalization of lottery procedures, it is possible to suppress a possibility that an inclination occurs in lottery results because of a difference in lottery procedures. In addition, the lottery device may be configured by the computer unit to select the prize to be given to the user randomly from the prizes belonging to the rank selected.

The lottery table may have: a game-terminal probability setting portion where a probability allocation for each rank is described, the probability allocation being referred to in a case of the lottery where the prize is selected from the group of prizes as the game-terminal lottery candidates; and a vendor probability setting portion where a probability allocation for each rank is described, the probability allocation being referred to in a case of the lottery where the prize is selected from the group of prizes as the vendor lottery candidates. Thereby, by adjustment of the probability allocation of each probability setting portion, it is possible to flexibly set the group of prizes as the lottery candidates and the probability allocation that the prizes included in the group are selected by separating the lottery for the game terminal apparatus and the lottery for the vendor apparatus, while communalizing plural prizes as the population. Of course, the group of prizes as lottery candidates and the probability allocation may be identical between the lottery for the game terminal apparatus and the lottery for the vendor apparatus.

In the game-terminal probability setting portion, the probability may be set to zero with respect to one part of the ranks, and in the vendor probability setting portion, the probability of at least one of the ranks whose probabilities may be set to zero in the game-terminal probability setting portion is set to more than zero. As there is no possibility that the rank whose probability is set to zero is selected in the lottery, such a rank is excluded from the lottery candidates. Thereby, it is possible to set a range of the groups of prizes as the lottery candidates appropriately. In addition, in a case that, to at least one of ranks whose probabilities are set to zero in the game-terminal probability setting portion, a probability more than zero is set in the vendor apparatus probability setting portion, it is possible to set the prizes included in the rank as the prizes obtainable only by the lottery for the vendor apparatus.

The vender apparatus may be provided with a charge collecting device which is configured to collect a lottery charge from the user, and the lottery request device of the vendor apparatus may be configured by the computer unit to request the lottery of the prize to the server apparatus, under a condition that the charge collecting device has collected the lottery charge. Thereby, while excluding a possibility that the prizes are output excessively by the lottery using the vendor apparatus, it is possible to give a value proper for the lottery charge to the prize put out from the vendor apparatus, and thereby, it is possible to enhance a satisfying sense of users with respect to the obtainment of prizes via the vender apparatus.

The server apparatus may have a device configured by the computer unit to, when verifying the user by receiving identification information of the user (as one example, the ID set uniquely for each user) from the game terminal apparatus, provide predetermined service to the game terminal apparatus of the user, and the lottery device may be configured by the computer unit to, while performing the lottery of the prize from the group of prizes as the game-terminal lottery candidates only when the user of the game terminal apparatus has been verified, perform the lottery from the group of prizes as the vendor lottery candidates without verifying the user of the vendor apparatus. Thereby, it is possible to provide an opportunity to obtain the prize using the vendor apparatus, even to the user who does not obtain his/her user identification information. Due to this, it is possible to enhance the effect of obtaining new users.

In the present invention, any type of terminal apparatus having an appropriate construction and any intended purpose can be applied as the game terminal apparatus, as long as the terminal apparatus is capable of allowing a user to play a game and accepting service provided from the server apparatus via a network. As one example, a terminal apparatus for personal use of a user may be used as the game terminal apparatus.

Effects of Invention

As mentioned above, according to the amusement system of the present invention, it is possible to provide to a user, not only an opportunity to obtain a prize in a virtual world of a closed online game, but also an opportunity to obtain a prize using the vendor apparatus. Accordingly, it is possible to expand the opportunity that the user obtains the prize. By using the existence of the vendor apparatus itself or the prizes put out from the vendor apparatus as a medium, it is possible to get publicity for the existence of a game and enhance the visibility of the game in an actual world. Thereby, it is possible to give motivation to play a game to a lot of users, and promote the expansion of the number of users of the game and the user segments of the game.

DESCRIPTION OF EMBODIMENTS

Figure 1:
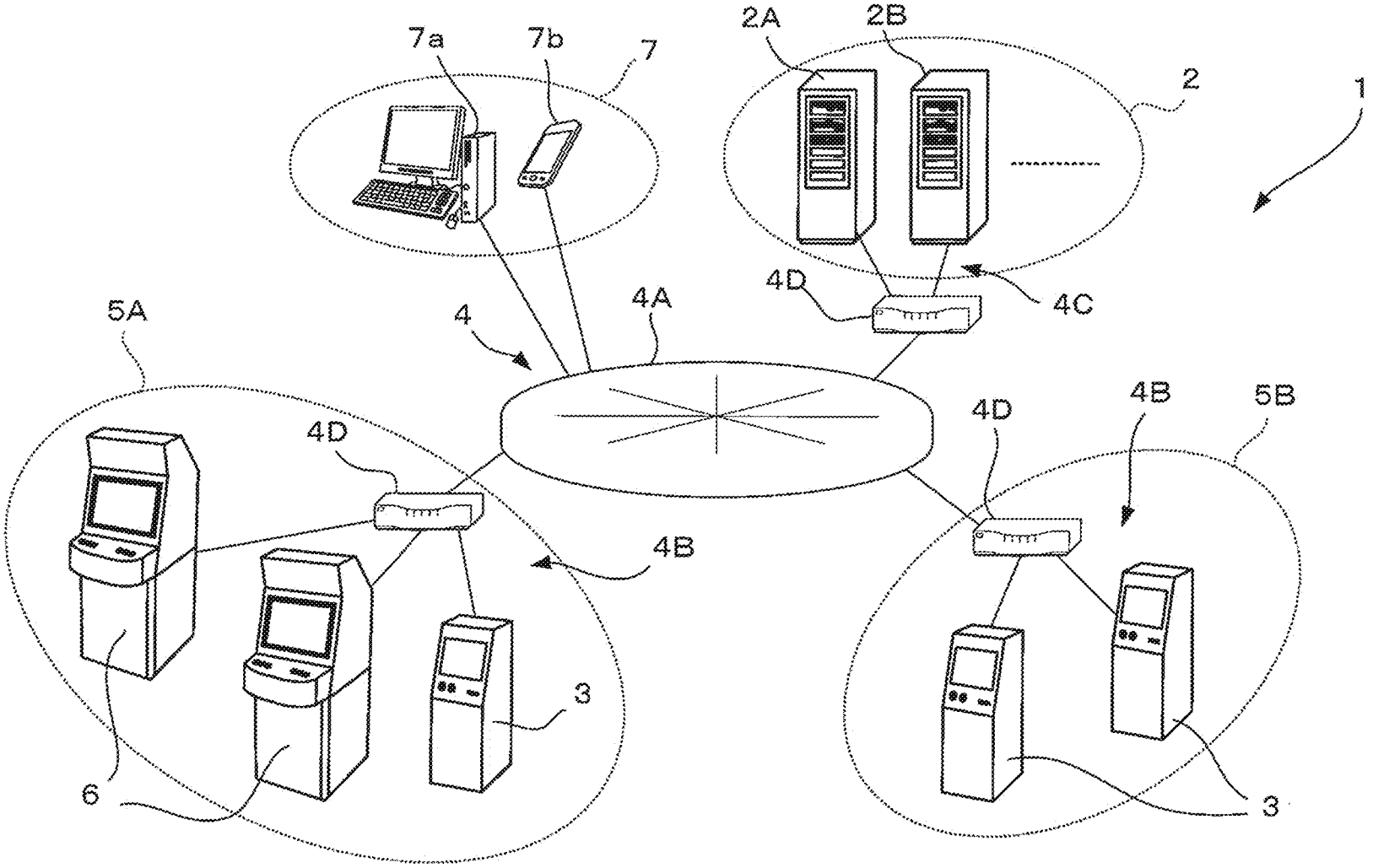
FIG. 1 is a diagram showing an entire configuration of an amusement system according to one embodiment of the present invention.

Hereinafter, an amusement system according to one embodiment of the present invention will be described. The present embodiment is an example that the present invention is applied to an amusement system which allows a user to play a game using a plurality of cards, performs a lottery using at least one portion of the cards as lottery candidates, and provides the user with one of the cards selected as a prize. First, in reference to FIG. 1, an entire configuration of the system will be described. The amusement system 1 includes a center server 2 as a server apparatus and a plurality of vendor apparatuses 3. The center server 2 and each of the vendor apparatuses 3 are connected with each other via a network 4. The center server 2 is configured as a single logical server apparatus consisting of a combination of plural server units 2A and 2B. However, a single server unit may be made to function as the center server 2. A single logical center server 2 may be configured using the cloud computing.

Each of the vendor apparatuses 3 is provided as a terminal apparatus for paying out a card to a user in exchange of a payment of a predetermined lottery charge. The vendor apparatuses 3 are installed to facilities such as stores 5A and 5B. The store 5A is a facility where a game machine 6 for commercial use (so called an arcade game machine) is installed, the game machine 6 allowing a user to play a game in exchange of a payment of a game-play charge, and corresponds to a commercial facility such as a game arcade or an amusement facility. However, the game machine 6 is not an essential element in the amusement system 1. Accordingly, the installation location of the vendor apparatus 3 is not limited to a facility where the game machine 6 is installed. The vendor apparatus 3 may be installed to a commercial facility 5B like a mall, where the game machine 6 is not expected to exist. The vendor apparatus 3 may be installed to a public facility. The network 4 is configured in such a way where the internet 4A and each of the LANs 4B and 4C are connected with each other via a router 4D, the LANs 4B and 4C connecting the vendor apparatus 3 and the center server 2 to the internet 4A respectively.

To the center server 2, a user terminal 7 is capable of connecting via the network 4. The user terminal 7 is a terminal apparatus for personal use which is provided for personal use of a user. It is possible to use as the user terminals, various kinds of computer apparatuses which are capable of connecting with a network and used for personal use, like a PC 7*a* and a portable phone (including a smart phone) 7*b*, for example. Not illustrated, but it is possible to also use as the user terminal 7, a computer apparatus such as a game machine for home use, a portable game machine, or a portable tablet terminal, as long as the computer apparatus functions as a network terminal apparatus, and also is provided for personal use.

The center server 2 provides predetermined service to the user terminal 7 and the vendor apparatus 3. In a case that the game machines 6 are connected to the network 4, the center server 2 may also provide service to the game machines 6. As the service provided to the user terminal 7 by the center server 2, there is a game service that allows a user to play a predetermined game while making the user terminal 7 function as an input device for operations relating to the game and an output device for image and sound relating to the game. As one part of the game service, the center server 2 also provides: service for verifying a user by accepting from the user terminal 7 a user ID (user identification information) unique for each user; and service for recording a game-play result of a user in game-play data and storing the game-play data in a storage device on the center server 2 in association with user verification information. In a case that a plurality of users play a common game via the network 4, the center server 2 may further provide service for mutchmaking the users. In a case that the game machine 6 is connected to the center server 2, the center server 2 may also provide the service relating to a game to the game machine 6. A game to be played on the game machine 6 may be correlated to a game to be played on the user terminal 7, and or may not be correlated. Hereinafter, if not otherwise specified in the following description, the term "game" indicates a game to be played on the user terminal 7.

Figure 2:
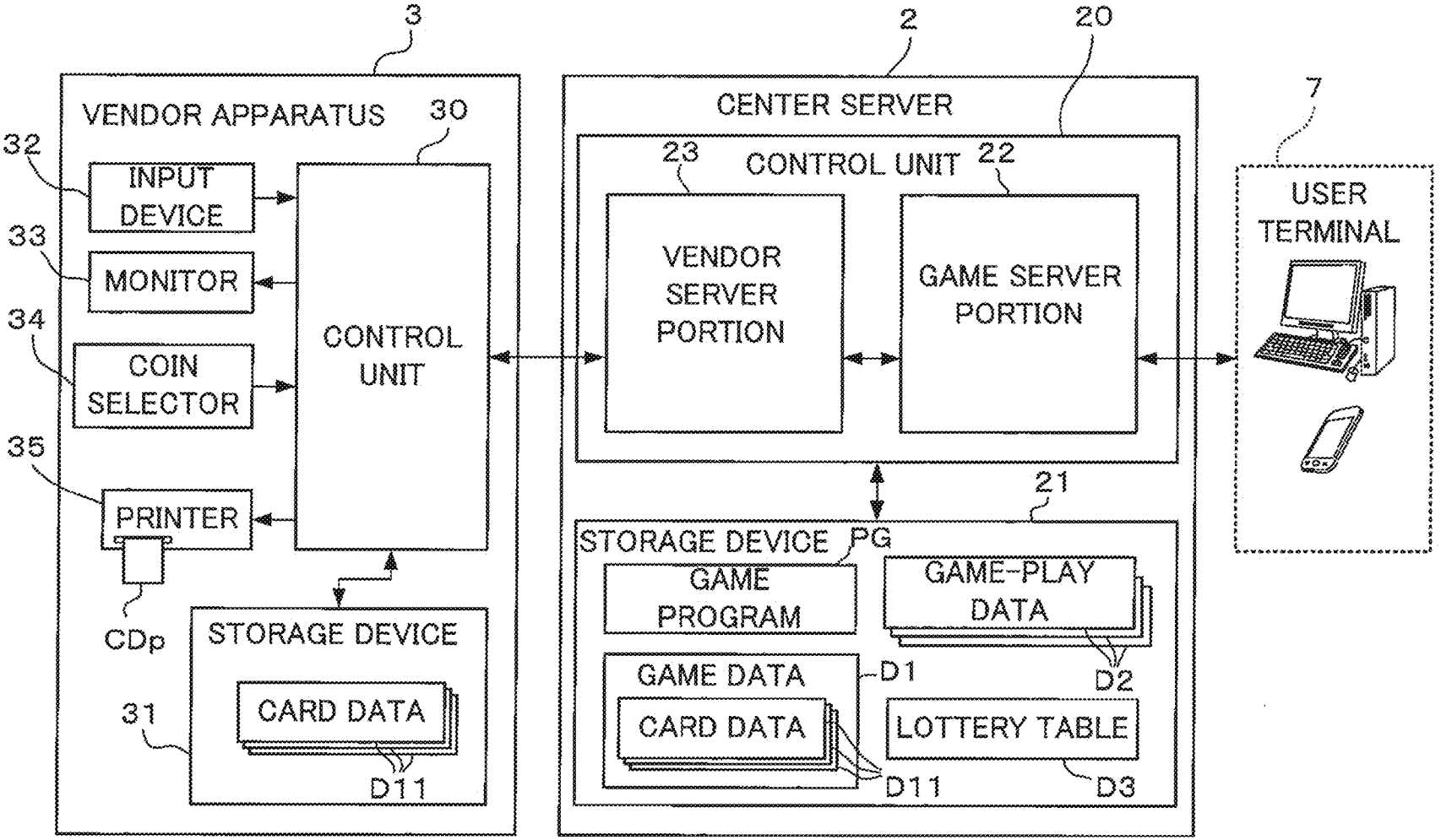
FIG. 2 is a functional block diagram with respect to main portions of the amusement system according to a first embodiment.

Next, in reference to FIG. 2, main portions of a control system relating to each of the center server 2 and the vendor apparatus 3 in the amusement system 1 will be described. First, the center server 2 will be described. The center server 2 is provided with a control unit 20 and a storage device 21. The control unit 20 is a computer unit consisting of a combination of a micro processor and peripheral devices such as an internal storage device (not illustrated) necessary for operations of the microprocessor. The storage device 21 is a storage device capable of holding memory such as a hard disc storage device. To the control unit 20, an input device such as a keyboard and an output device such as a monitor are connected, but those devices are not illustrated. The storage device 21 stores an operating system for a server (a server OS), various kinds of application programs to be executed on the server OS, and data groups to be referred to by the programs. The application programs include a game program PG for realizing the game service mentioned. As data stored in the storage device 21, there are game data D1, a group of game-play data D2, and a lottery table D3. A concrete example of each data will be described later. The game data D1 includes a group of card data D11, each card data D11 corresponding to each of a lot of cards available in the game.

In the control unit 20, a game server portion 22 and a vendor server portion 23 are provided. Each of the server portions 22 and 23 is a logical device which is realized by a combination of computer hardware of the control unit 20 and predetermined software. The game server portion 22 provides, in response to access from a user terminal 7, the game service to the user terminal 7. As one example, the game server portion 22 provides the SNS (an abbreviation of "Social Networking Service") function to the user terminal 7, and provides service for allowing a user to play a card game on the SNS. On the other hand, the vendor server portion 23 provides to the vender apparatus 3 a vendor service related to the output of prizes. In addition, the center server 2 has a charging function of: charging a service charge such as a game-play charge to a user of the user terminal 7 in cooperation with the user terminal 7; and collecting the service charge using a predetermined payment method. As the charging function may be configured in a similar way to a well-known system, and the details of the charging function will be omitted.

On the other hand, the vendor apparatus 3 is provided with a control unit 30 and a storage device 31. The control unit 30 is a computer unit consisting of a combination of a microprocessor and peripheral devices necessary for operations of the microprocessor such as an internal storage device. The storage device 31 is a storage device capable of holding memory such as a hard disc storage device. The storage device 31 stores programs to be executed by the control unit 30 and various kinds of data to be referred to by the programs. As one example, in the storage device 31, stored is the group of card data D11 delivered by the center server 2.

To the control unit 30, connected are an input device 32 such as an operation button, a monitor 33 as an output device, a coin-selector 34, and a printer 35. The coin-selector 34 is provided as a charge collecting device. The coin-selector 34 determines whether a coin (or a medal as substitute money can be used) put in to the vendor apparatus by a user is true or not, and outputs a signal corresponding to the number of or the money amount of coins determined as true ones. The printer 35 is a well-known printer which outputs information of a print object, such as images and letters, on a predetermined printing paper according to a print instruction issued from the control unit 30. However, the printing paper for the printer 35 is unified to a card mount having a predetermined size. The printer 35 is incorporated in a chassis of the vender apparatus 3. A card CDp printed by the printer 35 is put out to the user through an ejection portion of the vendor apparatus 3.

Figure 3:
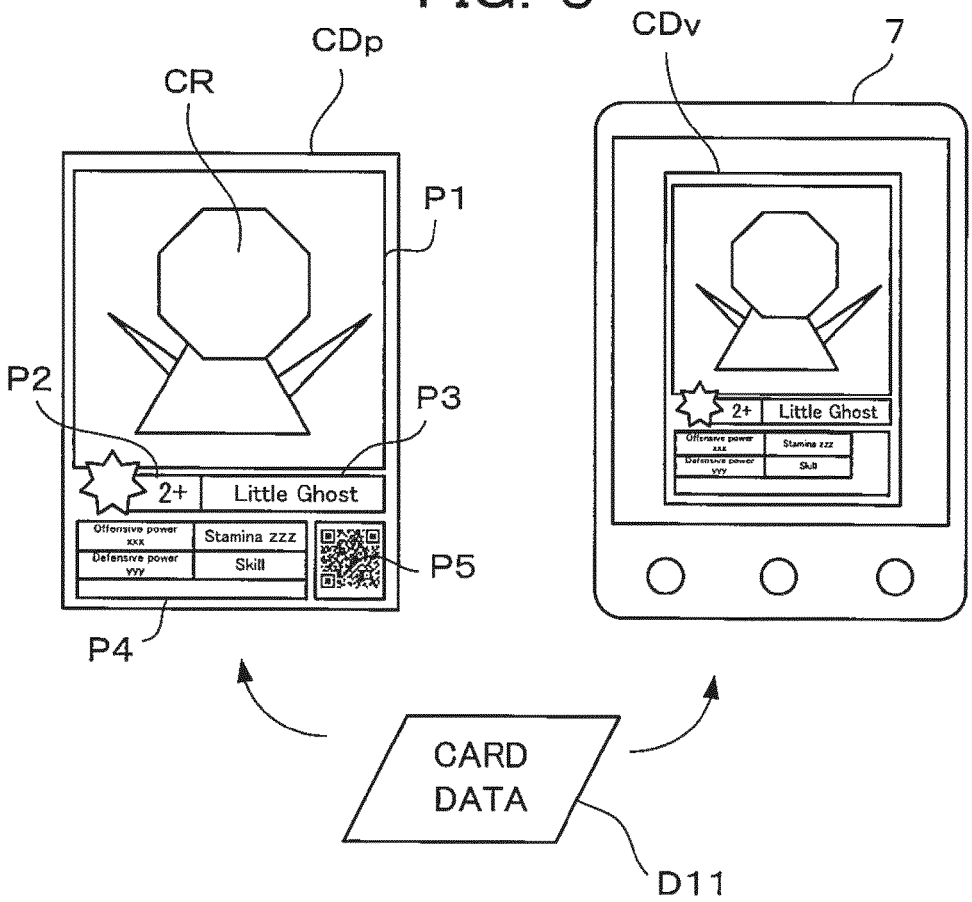
FIG. 3 is a diagram showing a relation between: card data and two types, virtual and physical, cards output based on the card data.

Next, in reference to FIGS. 3 to 6, the data stored in the storage device 21 of the center server 2 will be described concretely. First, in reference to FIGS. 3 and 4, the card data D11 will be described. As shown in FIG. 3, in the amusement system 1, the display output of a virtual card CDv is performed on a screen of the user terminal 7 based on the card data D11. On the other hand, the print output of a physical card CDp is performed by the printer 35 of the vendor apparatus 35 based on the card data D11. That is, the card data D11 is data which is generated for outputting a card CD to a user. Hereinafter, the card CDv and the card CDp are sometimes collectively called "the card CD". The physical card CDp is a card where the print output of an image of the virtual card CDv to be displayed on the user terminal 7 is performed on the card mount as a physical printing medium.

The format of the card CD may be set appropriately. In an example of FIG. 3, the card CD includes a character image portion P1, a rank portion P2, a name portion P3, and an attributes display portion P4. At the character image portion P1, an image of a character CR symbolizing the card CD is represented. At the rank portion P2, a rank of the card CD ("2+" in the example of FIG. 3) is displayed. At the name portion P3, the name of the character CR is displayed. At the attributes display portion P4, various kinds of card attributes such as an offensive power and a defensive power of the character CR in the game are displayed. In the amusement system 1, various kinds of cards CD different from each other in the character CR or the attributes are prepared. The card data D11 is correlated to a card number as a card identification information, the card number being unique for each kind of card CD. "The kind" of card CD being used here is a conception for distinguishing cards CD from each other depending on whether or not all information (contents) represented on the cards CD is identical with each other. That is, as many pieces of cards CD could be issued with respect to one kind, the conception of "kind" is used for treating the cards CD the contents of which are identical with each other as one prize in one lump. Accordingly, one kind of card corresponds to one prize, and a conception "for each kind of card" corresponds to "for each prize".

On the physical card CDp, provided is an identification information portion P5 where the card number is represented so as to be readable by the user terminal 7. As one example, the card number, which is 2-dimension bar-coded, is displayed at the identification information portion P5. Although the virtual card CDv is similar to the physical card CDp, the identification information portion P5 is omitted on the virtual card CDv.

The game to be played on the user terminal 7 includes a mode such that a user collects the cards CD to set a deck, and, while selecting appropriately one or more card(s) CD from the deck to use the card(s) CD, challenges a predetermined mission or battles a competitor. The attributes of the card CD mentioned above are parameters to be referred to when an achievement level for the mission and relative merits of the battle are calculated. As one of ways for a user to obtain the card CD, in the amusement system 1, prepared is a way such that the cared CD is given to a user as a prize through a lottery performed by the center server 2. The card number recorded on the identification information portion P5 is used in order for a user to use in the game, the virtual card CDv corresponding to the card CDp obtained from the vendor apparatus 3.

Figure 4:
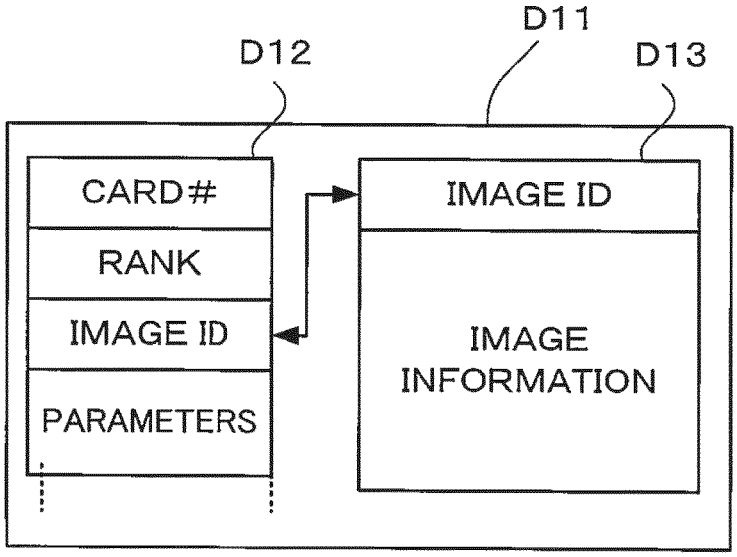
FIG. 4 is a diagram showing one example of data structure of the card data.

Next, in reference to FIG. 4, one example of a structure of the card data D11 will be described. In the example of FIG. 4, the card data D11 includes basic data D12 and image data D13. In the basic data D12, the card number (card #), the rank, an image ID, parameters and the like. The rank is an index of difficulty level with respect to obtainment of the card ID. The image ID is information for specifying the image data D13 to be used for representing the character CR. The parameters are information where various kinds of attributes to be given to the card CD are set. On the other hand, the image data D13 is data that image information for drawing the character CD is stored in association with the image ID. By referring to the basic data D12 and the image data D13 corresponding to the image ID specified by the basic data D12, it is possible to perform the display output of the card CD on the user terminal 7, or perform the printing output of the card CD using the printer 35. In addition, the identification information (the 2-dimension bar-code, the bar-code, or the like) of the physical card CDp is read out on the user terminal 7 to specify the card number, and the card data D11 corresponding to the card CDp is specified by collating the card number specified and the group of the card data D11. And then, it is possible to use the virtual card CDv corresponding to the card data D11 in the game, or to display the card CDv on the user terminal 7.

Next, the game-play data D2 will be described in reference to FIG. 5. The game-play data D2 is data that a result of the game played by a user is stored. The game-play data D2 is stored in the storage device 21 for a purpose that, for example, the user can play the game continuously from a previous state. As one example, in the game-play data D2, information such as game-play log, a status and owned cards are stored in association with the user ID. The game-play log is information having past game-play contents such as the number of times of past game-play and the past battle scores with respect to the user. The status is information for distinguishing various kinds of index values indicating a state of game progress such as a position, an achievement level, and a reach level which were obtained in the game by the user. The information of the owned cards is information for distinguishing the card ID obtained by a user in the game. As one example, the card number of the card CD the user has already obtained is stored as the information of the owned cards.

In a case that, after obtaining the card CD, the user can change the image and attributes of the character CR of the card CD depending on a state of his/her game achievement, the image ID and initial values of the attributes are stored in the card data 11, and with respect to the card CD obtained by the user, the card data D11 is copied in the game-play data D2 of the user, and the image ID and parameters of the card data copied may be changed.

Next, the lottery table D3 will be described in reference to FIG. 6. FIG. 6 is a diagram showing information stored in the lottery table D3 in a tabular form. As apparent from the example shown in FIG. 6, the lottery table D3 is a data table where a probability (the unit is "%") that the card CD will be selected in a lottery is recorded in association with the rank of the card CD and a type of lottery. The game server portion 22 of the center server 2 selects the card CD to be given to a user as the prize in reference to the lottery table D3.

Figures 5, 6:
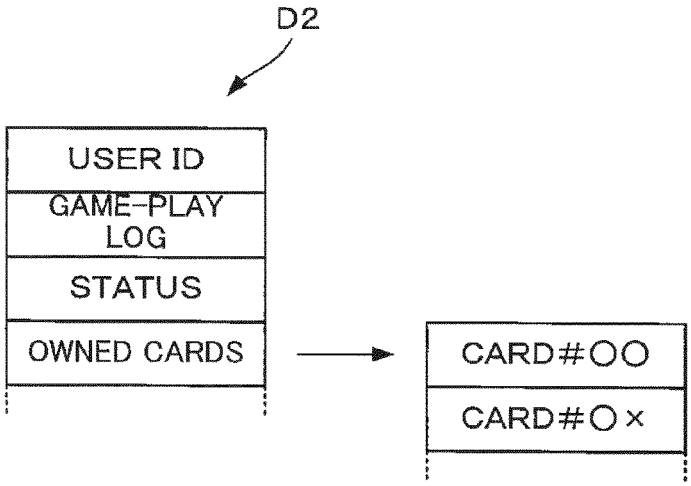
FIG. 5 is a diagram showing one example of data structure of game-play data.
FIG. 6 is a diagram showing the contents of a lottery table in a tabular form.

In the example of FIG. 6, as types of lottery, there are three types: "SNS Free"; "SNS Paid"; and "Vendor lottery". The SNS Free is a lottery which is performed free to a user accessing from the user terminal 7. The SNS Paid is a lottery which is performed to a user accessing from the user terminal 7 in exchange of payment of a predetermined lottery charge. The Vendor lottery is a lottery which is performed to a user of the vendor apparatus 3 in exchange of payment of a predetermined lottery charge. In the lottery charge, the SNS Paid may be identical with, or may be different from the Vendor lottery. With respect to the lottery of the SNS Free, a limitation such as once per day may be set. The lottery of the SNS Free may be allowed, when a predetermined condition related to the game is satisfied.

In FIG. 6, the ranks of cards CD are set so that the obtainment difficulty level of the card CD increases sequentially from left to right. The rank of the card CD which can be obtained most easily is "1", and the rank of the card CD which can be obtained most hard is "Xs". The probability for each rank is allocated so as to get smaller as the obtainment difficulty level gets higher. In a case that the SNS Free is compared with the SNS Paid, the probabilities are allocated so that the card CD having a comparative high rank is more likely to be selected in the SNS Paid. In a case that the SNS Paid is compared with the Vendor lottery, the probabilities are allocated so that the card CD having a comparative high rank is more likely to be selected in the Vendor lottery. Further, the rank with a subscript "s" ("2s", "2+s", "Xs", or the like) indicates that the card CD can be obtained only by the Vendor lottery. Then, each probability of the rank with the subscript "s" corresponding to each of the SNS Free and the SNS paid is set to zero (in FIG. 6, "-"). A set of cards CD each having the rank to which more than zero probability is set with respect to the SNS Free and the SNS Paid is a group of prizes as game-terminal lottery candidates. A set of cards CD each having the rank to which more than zero probability is set with respect to the Vendor lottery is a group of prizes as vendor lottery candidates. A part of probability allocation with respect to the SNS Free and the SNS Paid in FIG. 6 corresponds to a game-terminal probability setting portion of the present invention. A part of probability allocation with respect to the Vendor lottery in FIG. 6 corresponds to a vendor probability setting portion of the present invention.

Figure 7:
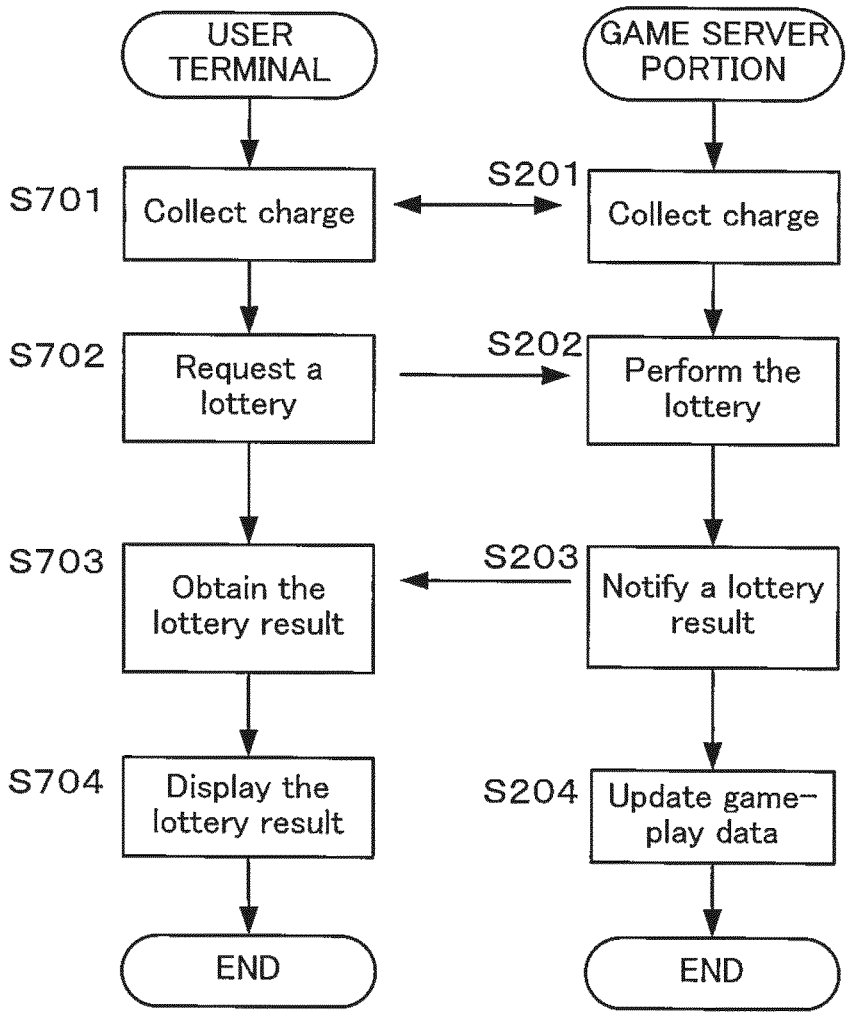
FIG. 7 is a flow chart showing the procedures of a prize lottery performed for a user terminal.

Next, various kinds of processing executed in association with a prize lottery by the center server 2 and the vendor apparatus 3 will be described. FIG. 7 shows the processing of the user terminal 7 and the game server portion 22 for performing an SNS Paid lottery in association with operations by a user to the user terminal 7. The processing shown in FIG. 7 is executed after the user operates the user terminal 7 to notify his/her identification information (the user ID) to the game server portion 22 of the center server 2, and user verification is completed. When the user requests to start the SNS Paid lottery to the user terminal 7, the processing for collecting from the user the lottery charge corresponding to the SNS Paid lottery is executed in a cooperation of the user terminal 7 and the game server portion 22 (step S701, step S201). The collection of the charge may be realized by communicating electronic information between the user terminal 7 and the game server portion 22. For example, payment means such as a charge collection by virtual money, electronic money or the like, or a charge collection by a credit card, may be applied.

When the charge collection is completed, the user terminal 7 requests a lottery to the game server portion 22 (step S702), and the game server portion 22 performs the lottery in response to the request (step S202). In this case, the game server portion 22 obtains the probability allocations set for the ranks correlated to the SNS Paid in reference to the lottery table 3. The game server portion 22 performs the lottery according to the probability allocations obtained to select the rank of the card CD to be given to the user. Then, the game server portion 22 selects in accordance with a predetermined rule, predetermined pieces of cards CD (for example, one piece of card CD) as the prize to be given to the user from a set of cards CD belonging to the rank selected. As the predetermined rule, a random selection could be applied as one example. However, the rule is not limited to the random selection. The rule may be set such that the card is selected according to probabilities differing from each other depending on the parameters and the like of the cards CD. The card CD selected is the prize won in the lottery.

When completing the lottery, the game server portion 22 notifies a lottery result to the user terminal 7 (step S203). In this case, information necessary for the display output of the won card CD on the user terminal 7 is provided to the user terminal 7 as at least one portion of the lottery result. The information is: for example, all of the card data D11 of the won card CD; or the image data D13 and the basic data D12 including the parameters and the name of the character CR. After that, the game server portion 22 updates the owned cards information of the game-play data D2 which is stored in the storage device 21 in association with the user ID of the user of the user terminal 7, so that the won card becomes an owned card of the user (step S204). After that, the processing in FIG. 7 is ended. The processing in step S204 corresponds to the processing for allowing the user to use the card data D11 corresponding to the card CD as the prize selected. For the user ID for specifying the game-play data D2 to be an updating object in step S204, the user ID obtained at the user verification may be used, the user ID for specifying the game-play data D2 may be obtained in step S702 from the user terminal 7 anew.

On the other hand, the user terminal 7 obtains the lottery result from the game server portion 22 (step S703), and displays the lottery result to the user (step S704). After that, the user terminal 7 ends the processing for the SNS Paid lottery. In a case of the SNS Free lottery, steps S701 and S201 are omitted, and instead of these steps, it may be determined whether or not a condition for performing the SNS Free lottery has been satisfied in association with an operation by the user to the user terminal 7. Any operation may be applied to the operation as a trigger for the SNS lottery (free or paid, whichever), as long as the operation is performed to the user terminal 7. For example, the operation may be an operation for requesting the start of the SNS lottery, may be an operation for starting game-play, or may be a predetermined operation during the game. In addition, the operation may be an operation to verify the user. However, as the lottery of the SNS Free is different from the lottery of the SNS Paid in the probability allocations to be referred to in the lottery table D3, it is necessary that the game server portion 22 distinguishes the lottery of the SNS Free and the lottery of the SNS Paid. It is possible to distinguish the type of lottery depending on whether or not the processing for charge collection has been executed.

Figure 8:
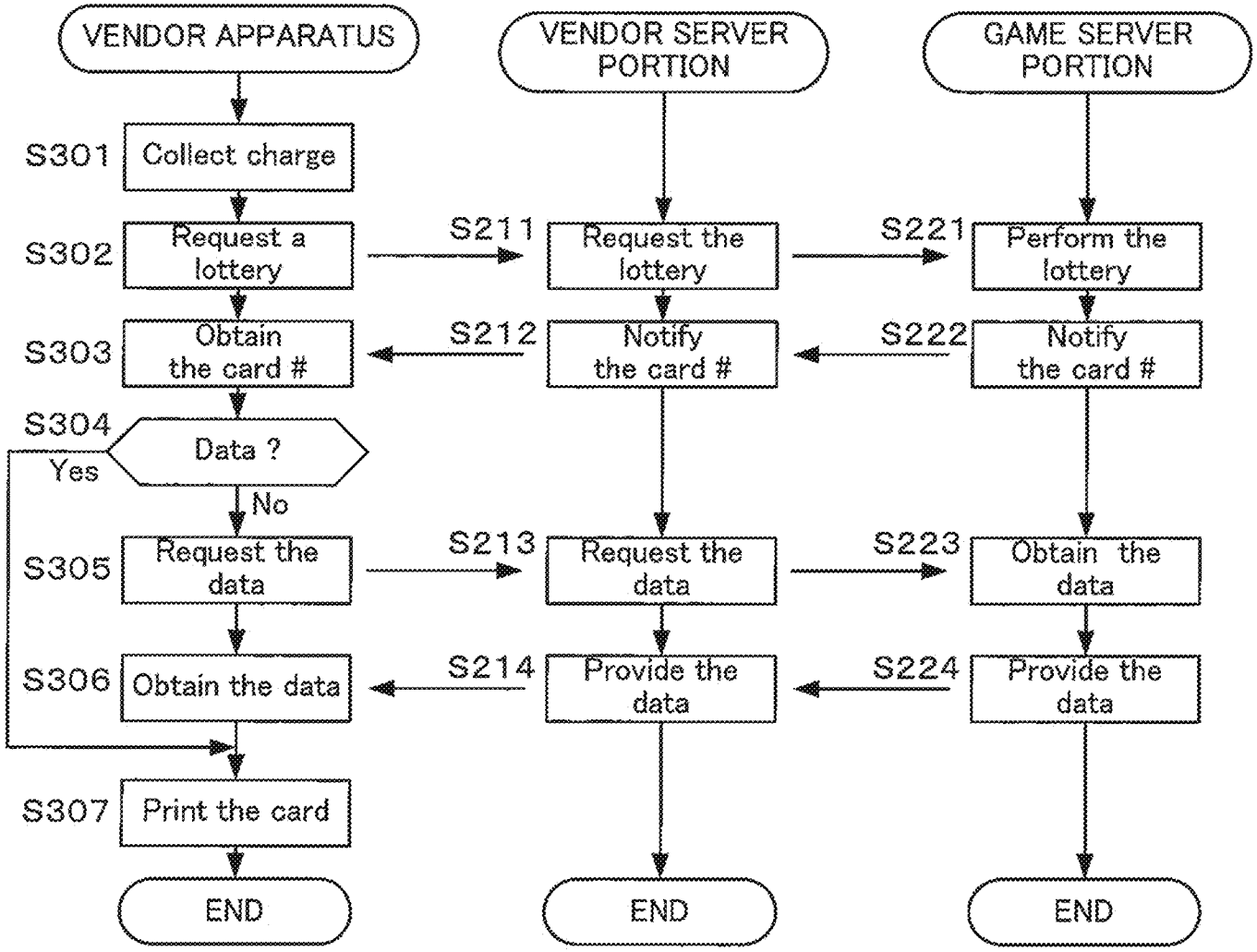
FIG. 8 is a flow chart showing the procedures of a prize lottery performed for a vendor apparatus.

FIG. 8 shows the processing of the vendor apparatus 3, the processing of the vender server portion 23 and the processing of the game server portion 22 for performing the Vendor lottery in response to an operation by a user to the vender apparatus 3. When a user operates the input device 32 of the vendor apparatus 3 to request the Vendor lottery, the vendor apparatus 3 (more specifically, the control unit 30) collects a predetermined lottery charge from the user (step S301). Here, the charge is collected through the coin-selector 34. When the charge is paid, the vendor apparatus 3 requests a lottery to the vendor server portion 23 (step S302), and the vender server portion 23 forwards the lottery request to the game server portion 22 (step S211). The game server portion 22 performs the Vendor lottery in response to the lottery request which has received via the vender server portion 23 (step S221). In this case, the game server portion 22 obtains the probability allocation for each rank correlated to the Vender lottery in reference to the lottery table D3, selects the rank of the card CD to be given to the user according to the probability allocations, and selects a predetermined pieces (for example, one piece) of cards CD according to a predetermined rules (for example, a rule of random selection is set) from the set of card CDs belonging to the rank selected. The card CD selected is the prize won in the lottery.

When completing the lottery, the game server portion 22 notifies the card number of the selected card CD to the vendor server portion 23 (step S222). The vendor server portion 23 notifies the card number as a lottery result to the vender apparatus 3 (step S212). The vendor apparatus 3 obtains the card number notified from the vender server portion 23 (step S303), and determines whether or not the card data D11 corresponding to the card number exists in the storage device 31 (step S304). When it is determined that the card data D11 does not exist, the vendor apparatus 3 requests to the vendor server portion 23, the card data D11 corresponding to the notified card number (step S305), and the vendor server portion 23 forwards the request to the game server portion (step S213). The game server portion 22 obtains from the storage device 21 thereof, the card data D11 requested (step S223), and provides to the vender server portion 23 the card data D11 obtained (step S224). The vender server portion 23 provides to the vender apparatus 3 the card data provided (step S214). The vendor apparatus 3 obtains the card data D11 provided from the vender server portion 23 and stores the card data D11 in the storage device 31 thereof (step S306). Subsequently, the vendor apparatus 3 executes the processing for making the printer 35 print the card CD corresponding to the card data D11 obtained (step S307). When it is determined that the card data D11 exists in step S304, the vendor apparatus 3 goes to step S307 by skipping steps S305 and S306. In this case, the card CDp is printed based on the card data D11 which has been already stored in the storage device 31. With that, the processing in FIG. 8 completes. The SNS lottery (free or paid, whichever) is different from the Vendor lottery in the probability allocations to be referred to in the lottery table D3 and the information to be included in a notification as the lottery result. Therefore, it is necessary for the game server portion 22 to distinguish the SNS lottery and the Vender lottery. It is possible to distinguish the SNS lottery and the Vender lottery by determining from which the lottery has been requested, the user terminal 7 or the vender server portion 23.

Figure 9:
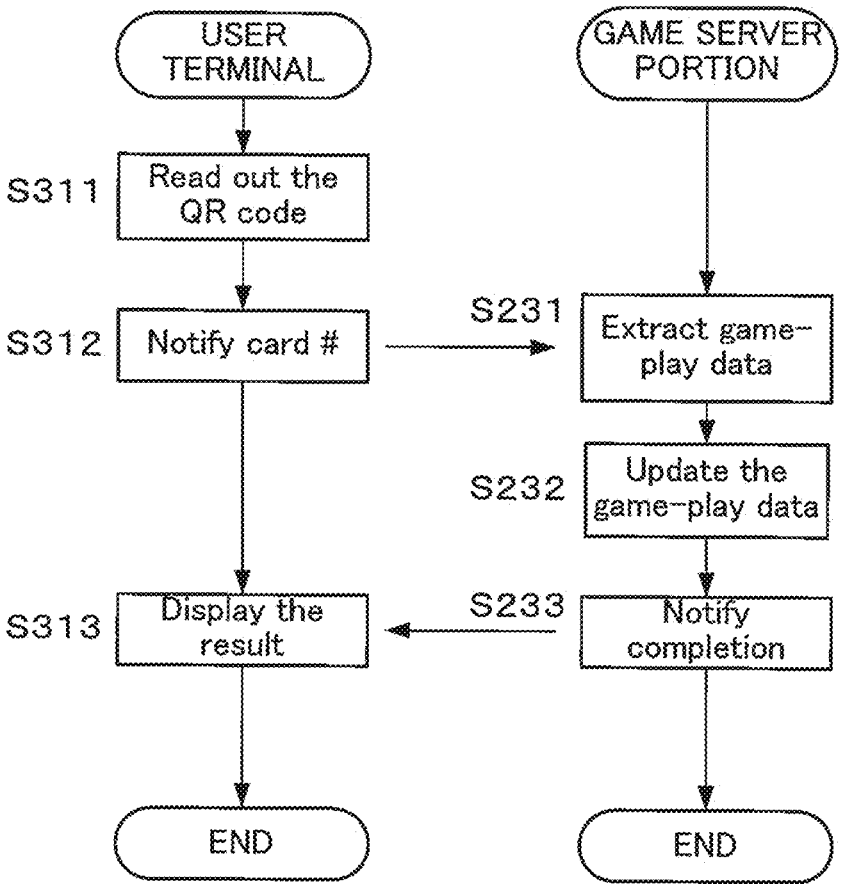
FIG. 9 is a flow chart showing the procedures for allowing a user to use in a game played on the user terminal, the card data corresponding to the card output on the vendor apparatus.

By the processing in FIG. 8, it is possible to put out the physical card CDp to the user from the vendor apparatus 3. FIG. 9 shows the processing of the user terminal 7 and the processing of the game server portion 22 for recording the virtual card CDv corresponding to the card CDp obtained by the user in the game-play data D2 as an owned card of the user in the game. Hereinafter, recording the card CDv in the game-play data D2 as the owned card of the user is sometimes represented as "register".

In the processing of FIG. 9, first, the user terminal 7 reads out the 2-dimension bar code recorded on the identification information portion P5 of the card CDp, and obtains the card number implanted to the 2-dimension bar code (step S311). Subsequently, the user terminal 7 notifies the obtained card number to the game server portion 22 (step S312). That is, the user terminal 7 specifies the card number read out from the card CDp and requests for the register of the card CDv corresponding to the card number specified. In this case, for making the game server portion 22 identify the user, the user ID may be also notified. In a case that the verification of the user has already completed between the user terminal 7 and the game server portion 22 prior to the processing of FIG. 9, the user ID the game server portion 22 obtained at the moment of the verification may be used as the verification information of the user in the processing of FIG. 9.

When the card number is notified from the user terminal 7, the game server portion 22 extracts the game-play data D2 stored in the storage device 21 by using the user ID obtained from the user terminal 7 as a key (step S231). Subsequently, the game server portion 22 updates the information of the owned cards in the game-play data D2 extracted in step S231, so that the card CDv corresponding to the card number accepted from the user terminal 7 is registered as the owned card of the user (step S232). As one example, As shown in FIG. 5, in a case that card numbers are recorded in the game-play data D2 as the information of the owned cards, the card number notified from the user terminal 7 may be added to the information of the owned cards. When the upper limit of the number of owned cards is set and the number of owned cards has reached the upper limit, the user may select a card to be deleted, and the card number to be deleted may be replaced with the card number newly obtained.

When the update of the game-play data completes, the game server portion 22 transmits a completion notification to the user terminal 7 (step S233), and after that, ends the processing in FIG. 9. When accepting the completion notification from the game server portion 22, the user terminal 7 outputs a display to the user, as a processing result, for intending that the register of the card CDv has completed (step S313). With that, the user terminal 7 ends the processing of FIG. 9.

As mentioned above, according to the amusement system 1 of the present invention, it is possible for a user to obtain a card CD prepared as the prize in the game, not only in the state of the virtual card CDv via the user terminal 7, but also in the state of the physical card CDp via the vendor apparatus 3 which is a physical apparatus different from the user terminal 7. Therefore, it is possible to expand the opportunities that a user obtains the prize. This effect gets more distinct, as the installed number of vendor apparatuses 3 and the number of places where the vendor apparatuses 3 are installed increase. By using the vendor apparatus 3 itself or the card CDp put out from the vendor apparatus 3 as a medium, it is possible to get publicity for the existence of the game and enhance the visibility of the game in the actual world. Thereby, it is possible to give motivation to play the game to a lot of users, and expand the number of users and kinds of users. If a design relating to the game (for example, a design of the character CR which appears in the game, a design resembling a symbol of the game) is given to the appearance of the vendor apparatus 3, it is possible to enhance an eye-catching effect on the vendor apparatus 3 itself, and possible to further improve the visibility of the game.

The virtual card CDv and the physical card CDp whose card numbers are identical with each other are displayed or printed based on the card data D11 shared by the cards CDv and CDp. Accordingly, it is possible to provide to a user the card CDp existing physically and actually, by replacing the card CDv existing virtually which is only displayed on the screen of the user terminal 7 with the card CDp. Thereby, it is possible to raise a user appetite for collection with respect to obtainment of the cards CD, or raise a feeling of pleasure of users with respect to owning the cards CD. In a case that a new card CD is added at the same timing of update of the game or the like, as long as the rank of the new card CD belongs to any one of the ranks stored in the lottery table D3 which has already existed, it is possible to add the new card CD to the group of prizes as the game-terminal lottery candidates or the group of prizes as the vendor lottery candidates appropriately for the rank thereof, only by storing the card data D11 corresponding to the new card CD in the storage device 21 of the center server 2. Even when a new rank is generated, only by rewriting the lottery table D3, it is possible to generate the new rank. As the maximum range of groups of prizes as the lottery candidates is shared, it is not necessary to prepare each set of cards data D11 for each type of lottery independently. It is possible to reduce troublesome work for storing data, and reduce an amount of data storage to be ensured on the storage device 21.

In this way, the set of cards CD included in the maximum range in which the cards CD can be set as the lottery candidates is shared between the lottery for the user terminal 7 and the lottery for the vendor apparatus 3, and, in the lottery table D3, the probability allocation is set for each rank appropriately with respect to each type of lottery. Thereby, as the group of prizes as lottery candidates is set for each type of lottery, it is possible to share the basic procedures for a lottery, that is, the procedures: reading out the probability allocations from the lottery table D3; selecting the rank; and selecting randomly a predetermined number of cards CD within the rank selected, regardless of the type of lottery. Thereby, it is possible to reduce the number of steps required for programming work relating to the lottery. Between the lottery for the user terminal 7 and the lottery for the vendor apparatus 3, while a possibility that an inclination of the lottery result is suppressed, the inclination occurring because of a difference in the lottery procedures, by adjusting the probability allocations in the lottery table D3, it is possible to set flexibly the groups of prizes as lottery candidates for each type of lottery, or it is possible to differentiate depending on the type of lottery, the probability that the prize of each rank is selected. Regardless of whether or not the type of lottery is different, the groups of prizes as lottery candidates and the probability allocations may be identical with each other.

The identification information portion P5 is provided on the physical card CDp. On the identification information portion P5, the card number as the card identification information for correlating the card CDp to the card data D11 is represented so as to be read out by the user terminal 7. Thereby, it is possible to correlate through the card number, the physical card CDp to the card data D11 and the virtual card CDv corresponding to the card data D11. Thereby, it is possible for a user which obtains the physical card CDp to use the card data D11 corresponding to the physical card CDp in his/her game-play. And, it is possible to display the virtual card CDv corresponding to the card data D11 as his/her owned card on the user terminal 7, and it is possible to progress the game using the card CDv. In the result, it is possible to further raise interest of the user who has obtained the physical card CDp to the game, and it is possible to give the user a strong motivation to the game-play.

In the lottery table D3, the probability allocations are set so that the rank obtainable only by the Vender lottery occurs, there is a card CD which is unobtainable when the game is played only on the user terminal 7. For a purpose of obtainment of such a card, it is possible to attract a user to the lottery for the vender apparatus 3. Thereby, it is possible to enhance the effect due to installation of the vender apparatus 3. If the probability of the card CDp which is obtainable only from the Vender lottery is set below, it is possible to position such a card CDp as a rare card which is rarely obtainable. Thereby, it is possible to further enhance the effect of attracting a user to the Vender lottery. In addition, by making the user terminal 7 read out the card number on the identification information portion P5 of the rare card, it is possible for a user to use the virtual card CDv corresponding to the rare card CDp. Because of this, it is possible to bring further strong user appetite for obtainment of the rare card, and to improve further distinctively the effect due to installation of the vender apparatus 3.

In the embodiment above mentioned, the game server portion 22 executes the processing of steps S202 and S204 of FIG. 7, and thereby, the game server portion 22 functions as a lottery device for a game terminal apparatus of the present invention. The control unit 30 of the vendor apparatus 3 executes the processing of step S302 of FIG. 8, and thereby, the control unit 30 functions as a lottery request device of the present invention. The control unit 30 executes the processing of steps S306 and S307 of FIG. 8 and the printer 35 performs the printing output of the card in response to the processing of step S307, and thereby, the control unit 30 and the printer 35 function as a prize output device of the present invention. The game server portion 22 executes the processing of steps S221 and S222 of FIG. 8, and thereby, the game server portion 22 functions as a lottery device for the vender apparatus of the present invention. Further, the game server portion 22 executes the processing of steps S231 and 232, and thereby, the game server portion 22 functions as an information processing device.

The present invention is not limited to the embodiment above mentioned, and also realized in various embodiments. For example, in the present invention, the game terminal apparatus is not limited to a terminal apparatus for personal use, and various types of game terminal apparatus, such as an arcade game machine, can be applied. The monitor on the vender apparatus is not imperative, and can be omitted, if appropriate. In a case that the lottery for the vender apparatus is performed by the server apparatus, in association with the lottery, an additional lottery may be performed by the vendor apparatus. As one example, in the additional lottery, it is selected whether or not an additional prize is given to a user. When the user wins, an additional lottery is requested to the server apparatus, and the prize additionally selected may be output to the user through the vender apparatus. In a case that the vender apparatus has a monitor (a display device), the state of the additional lottery may be presented to the user.

In the embodiment above mentioned, the prize data itself is provided from the server apparatus to the vender apparatus as prize output data. However, data equivalent to the prize data may be provided to the vender apparatus as the prize output data. For example, on the server apparatus, the prize data may be converted into printing data the printer 35 can recognize, and after the conversion, the printing data may be provided from the server apparatus to the vender apparatus to be stored in the storage device of the vender apparatus. The printing data may be generated based on the prize data by the server apparatus for each request from the vender apparatus. The printing data corresponding to the prize data may be prepared in advance and be stored in the storage device of the server apparatus, and such printing data may be provided to the vender apparatus. In addition, the data equivalent to the prize data may be data on which processing for reducing data communication amount between the server apparatus and the vender apparatus is given. For example, data that image data of the character is compressed, or data the number of pixels of the image data is reduced may be provided to the vender apparatus.

The output of the prize on the vender apparatus is not limited to the printing output. The prize data may be output to a storage medium brought by the user instead of, or in addition to, the printing output. For example, a physical model corresponding to the selected prize, such as a model resembling an appearance and a figure of the character or an item as the selected prize, may be output as the physical prize from the vender apparatus. Such a model may be output in such a way that a modeling device such as a 3D printer using laser beam lithography is built in the vender apparatus instead of, or in addition to, the printer for printing-output, the model is made and output on the vender apparatus based on the prize output data. The physical prize such as printed matters and models may be made and stored in the vender apparatus before performing the lottery. Alternatively, in a case that the model is given to a user as the prize, the following system may be applied: a printed matter where information for trading the model as the prize is recorded, such as a ticket or a token, is output as one part of the physical prize; and the user can obtain the prize by using the printed matter. In a case that the physical prize is given to a user via the ticket or the like, the ticket or the like is not always a physical matter. Information of the ticket or the like may be output as data to a storage medium brought by the user. Especially, the output to the storage medium is effective, in a case that sound data to be used in a game (as one example, data for a tune or the like in a music game) is set as the prize. Alternatively, by giving to the vendor apparatus, a data communication function like an infrared communication or a Near Field Communication, data communication may be performed between the terminal apparatus for personal use of a user and the vendor apparatus to output the prize data to the user.

In the embodiment above mentioned, by providing the identification information portion P5 on the physical card CDp, it is possible to replace the physical card CDv with the virtual card CDv so that the user can use the virtual card CDv in the game. However, the following system may be applied: the server apparatus specifies the card data D11 corresponding to the card CDp in such a way that the identification information portion P5 is omitted and an image of the card CDp is provided from the user terminal 7 to the server apparatus to execute imagery analysis processing. Alternatively, the following system may be applied: the processing for replacing the physical card CDp with the virtual card CDv is omitted, and the physical card CDp is provide to a user as an item which is a collection object. Alternatively, the following system may be applied: a deck of physical cards CDp is sold and users can play an actual-card battle game using the deck. In this case, the vendor apparatus 3 also functions as a device which allows a user to obtain a card usable in the actual-card battle game. In this way, even if it is impossible to replace the physical prize with the virtual prize, a user who has obtained the actual prize via the vender apparatus, sometimes wants to obtain the virtual prize by the lottery for the game terminal apparatus. Thereby, it is possible to give a motivation for the game-play to the user. The prize is not limited to a card, and various kinds of elements can be set as the prize. For example, each of the various kinds of items to be set in a game by a user or a character set as an operation object of the user may be set as the prize, the items including: arms; protectors; tools; magic; spells; lethal techniques; clothes or the like. Alternatively, as mentioned above, the sound data to be used in a game may be set as the prize. A title screen of a game, wall paper of a game screen, or each of the other elements may be set as the prize.

The invention claimed is:

1. An amusement system including a server apparatus to which a game terminal apparatus for playing a predetermined game connects via a network, the server apparatus being provided with: a storage device configured to store prize data corresponding to each of a plurality of prizes related to the game and store prize-group information indicating at least a first part of the plurality of prizes as a first group of prizes comprising game terminal lottery candidates; a computer unit; and a lottery device configured by the computer unit to execute processing for selecting, by reference to the prize-group information, a prize to be given to a user from the first group of prizes the prize being selected in association with an operation by the user to the game terminal apparatus, and for making the prize data corresponding to the prize selected available for the user in the game, wherein the amusement system further includes a vendor apparatus configured as a physical apparatus different from the game terminal apparatus and connected to the server apparatus via the network, wherein the vendor apparatus is provided with:

a computer unit;

a lottery request device which is configured by the computer unit to request a lottery for a prize to the server apparatus based on an operation by a user; and a prize output device which is configured by the computer unit to obtain the prize data or data equivalent to the prize data from the server apparatus as prize output data, and output the prize to the user in a predetermined state based on the prize output data, the prize-group information further indicates at least a second part of the plurality of prizes as a second group of prizes comprising vendor apparatus lottery candidates, the second part including at least one part of the first group of prizes as the game terminal lottery candidates;

the lottery device of the server apparatus is configured by the computer unit to, in response to a request for the lottery from the lottery request device of the vendor apparatus, select by reference to the prize-group information, the prize to be given to the user from the group of prizes and notify information for identifying the prize selected to the vendor apparatus, and the prize output device of the vendor apparatus is configured by the computer unit to identify the prize selected based on the information notified from the lottery device, and output a physical prize for the user based on the prize output data corresponding to the prize identified.

2. The amusement system according to claim 1, wherein the prize output device is configured by the computer unit to output the physical prize by printing on a predetermined printing medium, an image at least one part of which is shared with the prize to be displayed on the game terminal apparatus based on the prize data.

3. The amusement system according to claim 2, wherein the prize output device is configured to perform printing output of an identification information portion on the printing medium together with the image of the prize, the identification information portion representing the information for identifying the prize selected in a readable manner for the game terminal apparatus, and the server apparatus is further provided with an information processing device configured by the computer unit to execute processing for: obtaining from the game terminal apparatus, the information for identifying the prize read out from the identification information portion by the game terminal apparatus; identifying the prize outputted by the prize output device based on the information obtained; and allowing the user to use in the game the prize data corresponding to the prize identified.

4. The amusement system according to claim 1, wherein the prize output device is configured by the computer unit to output a model corresponding to the identified prize as the physical prize based on the prize output data.

5. The amusement system according to claim 1, wherein the vendor apparatus is further provided with a storage device storing the prize output data obtained from the server apparatus, the prize output device is configured by the computer unit to: determine whether or not the prize output data corresponding to the identified prize exists in the storage device of the vendor apparatus; output the prize for the user based on the prize output data in the storage device when the prize output data exists; and obtain the prize output data from the server apparatus to make the storage device of the vendor apparatus store the prize output data when the prize output data does not exist.

6. The amusement system according to claim 1, wherein the second group of prizes as the vendor lottery candidates includes a prize which is not included in the first group of prizes as the game-terminal lottery candidates.

7. The amusement system according to claim 1, wherein the plurality of prizes are sectioned into a plurality of ranks, the prize-group information stored in the storage device of the server apparatus is designed as a lottery table where a probability that each rank is selected in the lottery is allocated for each rank of the prize, and the lottery device is configured by the computer unit to select one of the ranks according to the probability described in the lottery table, and select according to a predetermined rule, the prize to be given to the user from the prizes belonging to the rank selected.

8. The amusement system according to claim 7, wherein the lottery device is configured by the computer unit to select the prize to be given to the user randomly from the prizes belonging to the rank selected.

9. The amusement system according to claim 7, wherein the lottery table has: a game-terminal probability setting portion where a probability allocation for each rank is described, the probability allocation being referred to in a case of the lottery where the prize is selected from the first group of prizes as the game-terminal lottery candidates; and a vendor probability setting portion where a probability allocation for each rank is described, the probability allocation being referred to in a case of the lottery where the prize is selected from the second group of prizes as the vendor lottery candidates.

10. The amusement system according to claim 9, wherein in the game-terminal probability setting portion, the probability is set to zero with respect to one part of the ranks, and in the vendor probability setting portion, the probability of at least one of the ranks whose probabilities are set to zero in the game-terminal probability setting portion is set to more than zero.

11. The amusement system according to claim 1, wherein the vendor apparatus is provided with a charge collecting device which is configured to collect a lottery charge from the user, and the lottery request device of the vendor apparatus is configured by the computer unit to request the lottery of the prize to the server apparatus, under a condition that the charge collecting device has collected the lottery charge.

12. The amusement system according to claim 1, wherein the server apparatus has a device configured by the computer unit to, when verifying the user by receiving identification information of the user from the game terminal apparatus, provide predetermined service to the game terminal apparatus of the user, and the lottery device is configured by the computer unit to, while performing the lottery of the prize from the first group of prizes as the game-terminal lottery candidates only when the user of the game terminal apparatus has been verified, perform the lottery from the second group of prizes as the vendor lottery candidates without verifying the user of the vendor apparatus.

13. The amusement system according to claim 1, wherein the game terminal apparatus is a terminal apparatus for personal use of the user.

* * * * *